US007147733B2

(12) United States Patent
Barnes et al.

(10) Patent No.: US 7,147,733 B2
(45) Date of Patent: Dec. 12, 2006

(54) AMMONIUM PERCHLORATE-CONTAINING GAS GENERANTS

(75) Inventors: Michael W. Barnes, Brigham City, UT (US); Ivan V. Mendenhall, Providence, UT (US); Robert D. Taylor, Hyrum, UT (US)

(73) Assignee: Autoliv ASP, Inc., Ogden, UT (US)

( * ) Notice: Subject to any disclaimer, the term of this patent is extended or adjusted under 35 U.S.C. 154(b) by 234 days.

(21) Appl. No.: 10/899,451

(22) Filed: Jul. 26, 2004

(65) Prior Publication Data

US 2005/0067076 A1 Mar. 31, 2005

Related U.S. Application Data

(63) Continuation-in-part of application No. 10/627,433, filed on Jul. 25, 2003, now abandoned.

(51) Int. Cl.
*C06B 31/00* (2006.01)
*C06B 29/22* (2006.01)

(52) U.S. Cl. ..... 149/42; 149/77

(58) Field of Classification Search ..... None
See application file for complete search history.

(56) References Cited

U.S. PATENT DOCUMENTS

| | | | |
|---|---|---|---|
| 5,518,054 | A | 5/1996 | Mitson et al. |
| 5,592,812 | A | 1/1997 | Hinshaw et al. |
| 5,608,183 | A | 3/1997 | Barnes et al. |
| 5,635,668 | A | 6/1997 | Barnes et al. |
| 5,641,938 | A | 6/1997 | Holland et al. |
| 5,663,524 | A | 9/1997 | Bucerius et al. |
| 5,670,740 | A | 9/1997 | Barnes et al. |
| 5,861,571 | A | 1/1999 | Scheffee et al. |
| 5,959,242 | A | 9/1999 | Knowlton et al. |
| 5,970,703 | A | 10/1999 | Hinshaw et al. |
| 6,004,411 | A | 12/1999 | Zeuner et al. |
| 6,045,638 | A | 4/2000 | Lundstrom |
| 6,051,158 | A | 4/2000 | Taylor et al. |

(Continued)

FOREIGN PATENT DOCUMENTS

| | | |
|---|---|---|
| DE | 44 42 169 | 12/1995 |

(Continued)

*Primary Examiner*—John R. Hardee
(74) *Attorney, Agent, or Firm*—Sally J Brown

(57) ABSTRACT

Ammonium perchlorate-containing gas generant compositions which, upon combustion, produce or result in an improved effluent and related methods for generating an inflation gas for use in an inflatable restraint system are provided. Such ammonium perchlorate-containing gas generant compositions include ammonium perchlorate present with a mean particle size in excess of 100 microns. Such ammonium perchlorate-containing gas generant compositions also include or contain a chlorine scavenger present in an amount effective to result in a gaseous effluent that is substantially free of hydrogen chloride when the gas generant is combusted, wherein at least about 98 weight percent of the chlorine scavenger is a copper-containing compound. Suitable copper-containing chlorine scavenger compounds include basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof.

26 Claims, 1 Drawing Sheet

U.S. PATENT DOCUMENTS

| | | | |
|---|---|---|---|
| 6,077,372 | A | 6/2000 | Mendenhall et al. |
| 6,096,147 | A | 8/2000 | Taylor et al. |
| 6,103,030 | A | 8/2000 | Taylor et al. |
| 6,132,537 | A | 10/2000 | Zeuner et al. |
| 6,132,538 | A | 10/2000 | Mendenhall et al. |
| 6,143,102 | A | 11/2000 | Mendenhall et al. |
| 6,241,281 | B1 | 6/2001 | Hinshaw et al. |
| 6,340,401 | B1 | 1/2002 | Wheatley et al. |
| 6,436,211 | B1 | 8/2002 | Mendenhall et al. |
| 6,712,918 | B1 | 3/2004 | Mendenhall et al. |
| 2003/0145921 | A1 | 8/2003 | Blomquist et al. |
| 2004/0200554 | A1 | 10/2004 | Mendenhall et al. |

FOREIGN PATENT DOCUMENTS

| | | | |
|---|---|---|---|
| DE | 102 30 402 A1 | | 1/2004 |
| WO | WO 98/47836 | * | 10/1998 |
| WO | 99/31029 | | 6/1999 |
| WO | WO 99/31029 | * | 6/1999 |

* cited by examiner

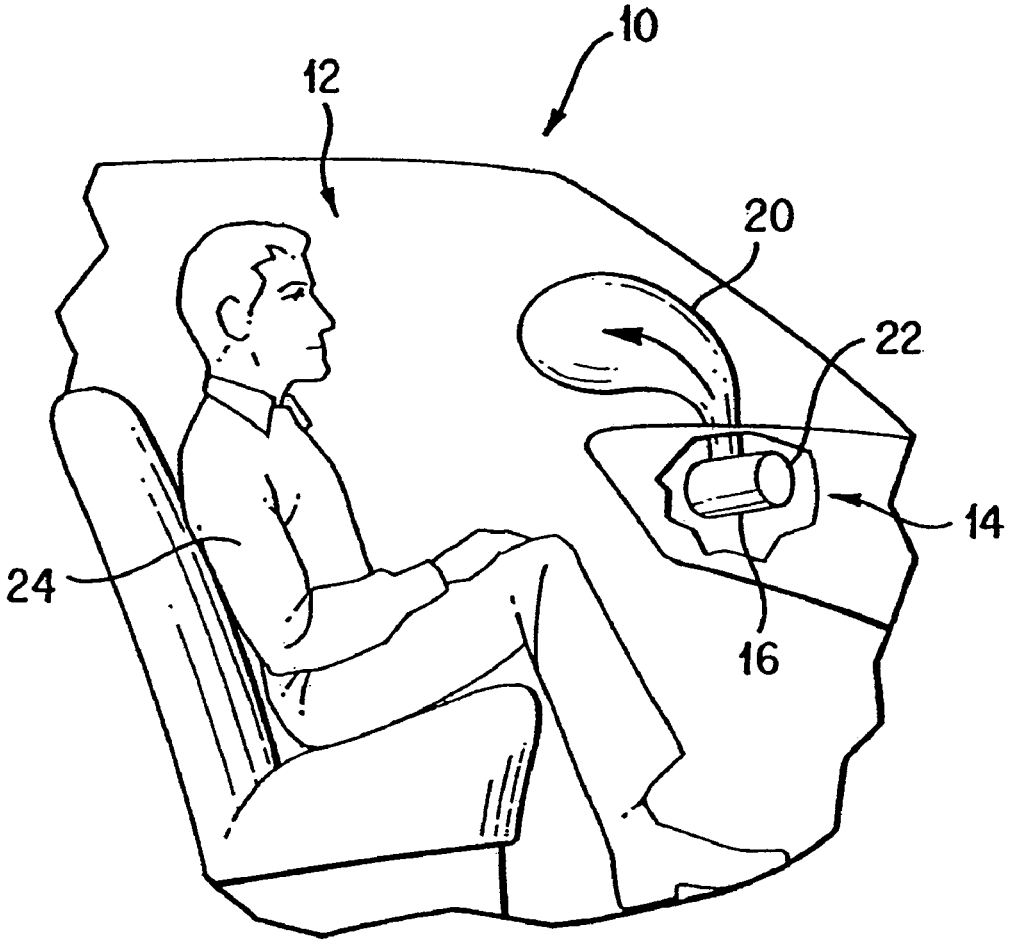
FIGURE

AMMONIUM PERCHLORATE-CONTAINING GAS GENERANTS

CROSS REFERENCE TO RELATED APPLICATION

This application is a continuation-in-part of U.S. application Ser. No. 10/627,433, filed on 25 Jul. 2003 now abandoned. The co-pending parent application is hereby incorporated by reference herein in its entirety and is made a part hereof, including but not limited to those portions which specifically appear hereinafter.

BACKGROUND OF THE INVENTION

This invention relates generally to gas generation and, more particularly, to gas generation via chlorine-containing gas generant compositions which produce or result in gaseous effluents substantially free of hydrogen chloride.

It is well known to protect a vehicle occupant using a cushion or bag, e.g., an "airbag cushion" that is inflated or expanded with a gas when a vehicle experiences a sudden deceleration, such as in the event of a collision. Such airbag restraint systems normally include: one or more airbag cushions, housed in an uninflated and folded condition to minimize space requirements; one or more crash sensors mounted on or to the frame or body of the vehicle to detect sudden deceleration of the vehicle; an activation system electronically triggered by the crash sensors; and an inflator device that produces or supplies a gas to inflate the airbag cushion. In the event of a sudden deceleration of the vehicle, the crash sensors trigger the activation system which in turn triggers the inflator device which begins to inflate the airbag cushion, typically, in a matter of milliseconds.

Many types of inflator devices have been disclosed in the art for inflating one or more inflatable restraint system airbag cushions. Inflator devices which form or produce inflation gas via the combustion of a gas generating pyrotechnic material, e.g., a "gas generant," are well known. For example, inflator devices that use the high temperature combustion products, including additional gas products, generated by the burning of the gas generant to supplement stored and pressurized gas to inflate one or more airbag cushions are known. In other known inflator devices, the combustion products generated by burning the gas generant may be the sole or substantially sole source for the inflation gas used to inflate the airbag cushion. Typically, such inflator devices include a filter to remove dust or particulate matter formed during the combustion of a gas generant composition from the inflation gas to limit or prevent occupant exposure to undesirable and/or toxic combustion byproducts.

In view of an increased focus on passenger safety and injury prevention, many automotive vehicles typically include several inflatable restraint systems, each including one or more inflator devices. For example, a vehicle may include a driver airbag, a passenger airbag, one or more seat belt pretensioners, one or more knee bolsters, and/or one or more inflatable belts, each with an associated inflator device, to protect the driver and passengers from frontal crashes. The vehicle may also include one or more head/thorax cushions, thorax cushions, and/or curtains, each with at least one associated inflator device, to protect the driver and passengers from side impact crashes. Generally, the gaseous effluent or inflation gas produced by all of the inflator devices within a particular vehicle, when taken as whole, are required to not include more than 5 parts per million hydrogen chloride in order to meet current industry safety guidelines. Thus, it is desired that the gas generant compositions used in such inflator devices produce as little hydrogen chloride as possible.

A number of gas generant compositions are known that include ammonium perchlorate as an oxidizer. Ammonium perchlorate is typically employed in gas generant compositions as a source of oxygen which promotes efficient combustion of the gas generant composition, e.g., complete conversion of carbon to carbon dioxide ($CO_2$), hydrogen to water ($H_2O$) and nitrogen to nitrogen gas ($N_2$). Ammonium perchlorate, however, commonly also produces hydrogen chloride as a gaseous byproduct of combustion which, in too large a concentration, may be both toxic and corrosive. Hydrogen chloride gas can be "scavenged" or removed from the combustion gas stream by including a scavenger compound such as an alkali or alkaline earth metal nitrate such as sodium or potassium nitrate in the pyrotechnic gas generant composition. Such alkali or alkaline earth metal nitrates react with the hydrogen chloride to produce less or nontoxic alkali or alkaline earth metal chlorides such as sodium or potassium chloride. Such alkali or alkaline earth metal chlorides may, however, undesirably form as fine particulate matter or dust which can escape the inflator device. Additionally, the inclusion of ammonium perchlorate typically increases the combustion temperature of a pyrotechnic gas generant composition often resulting in increased levels of undesirable and potentially toxic effluent gases such as ammonia and carbon monoxide.

In view of the above, there is a need and a demand for pyrotechnic gas generant compositions that take advantage of the increased heat and oxygen provided by utilizing ammonium perchlorate as an oxidizer without undesirably increasing undesired gaseous and particulate combustion byproducts in the inflation gas stream. More particularly, there is a need and a demand for gas generant compositions that permit or facilitate the inclusion of chlorine-containing components or materials such as by either or both: 1) providing or resulting in a chlorine-containing effluent material, such as a relatively easily filterable metal chloride, such as can be effectively and efficiently removed from the gas stream within the inflator and 2) inhibit the formation of carbon monoxide and ammonia gases. There is a further need and a demand for gas generant compositions that provide improved gas yields and burn rates.

SUMMARY OF THE INVENTION

A general object of the invention is to provide an improved gas generant composition.

A more particular object of the invention is to provide a chlorine-containing gas generant composition the combustion of which results in an improved gaseous effluent or inflation gas.

A more specific objective of the invention is to overcome one or more of the problems described above.

The general object of the invention can be attained, at least in part, through a chlorine-containing gas generant composition including a nitrogen-containing fuel, ammonium perchlorate oxidizer, and a chlorine scavenger present in an amount effective to result in a gaseous effluent substantially free of hydrogen chloride when the gas generant is combusted, the chlorine scavenger containing at least about 98 weight percent of a copper-containing compound. Suitably, the chlorine-containing gas generant composition contains no more than about 1 composition weight percent of a copper-free chlorine scavenger.

The prior art generally fails to provide a chlorine-containing gas generant composition that takes advantage of the increased heat and oxygen provided by utilizing ammonium perchlorate as an oxidizer without increasing undesirable gaseous and particulate combustion byproducts in the inflation gas stream. Particularly, the prior art fails to provide a chlorine-containing gas generant that utilizes ammonium perchlorate and a copper-containing compound that produces a filterable metal chloride to remove hydrogen chloride from a gaseous effluent resulting in an improved inflation gas.

The invention further comprehends a method for inflating an airbag cushion of an inflatable restraint system of a motor vehicle including the steps of igniting a chlorine-containing gas generant composition that includes a nitrogen-containing fuel, ammonium perchlorate oxidizer, and an effective amount of a copper-compound to produce an inflation gas that is substantially free of hydrogen chloride, and inflating the airbag cushion with the inflation gas.

The invention still further comprehends a chlorine-containing gas generant composition providing an improved gaseous effluent, including:

about 1 to about 20 composition weight percent ammonium perchlorate oxidizer; and about 80 to about 99 composition weight percent of a precursor blend including guanidine nitrate fuel and a chlorine scavenger in an amount effective to result in a gaseous effluent substantially free of hydrogen chloride, wherein at least 98 weight percent of the chlorine scavenger is a copper-containing compound.

One aspect of the invention is the provision of an improved ammonium perchlorate-containing gas generant composition that includes a non-azide, organic, nitrogen-containing fuel. In accordance with one specific embodiment of the invention, the improvement comprises the ammonium perchlorate being present with a mean particle size in excess of 100 microns, and the ammonium perchlorate-containing gas generant composition also containing a chlorine scavenger present in an amount effective to result in a gaseous effluent that is substantially free of hydrogen chloride when the gas generant is combusted. More particularly, at least about 98 weight percent of the chlorine scavenger is a copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof.

In accordance with one preferred embodiment, the invention provides an ammonium perchlorate-containing gas generant composition consisting essentially of:

a non-azide, organic, nitrogen-containing fuel, a copper-containing chlorine scavenger selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof, about 1 to about 10 composition weight percent ammonium perchlorate in a mean particle size in excess of 100 microns and about 1 to about 5 composition weight percent of at least one metal oxide burn rate enhancing and slag formation additive selected from the group consisting of silicon dioxide, aluminum oxide, zinc oxide, and combinations thereof, wherein the gas generant composition contains no more than about 1 composition weight percent of a copper-free chlorine scavenger, wherein the non-azide, organic, nitrogen-containing fuel, the copper-containing chlorine scavenger, the ammonium perchlorate and metal oxide burn rate enhancing and slag formation additive are present in sufficient relative amounts that the gas generant composition has an equivalence ratio in the range of about 0.96 to about 1.06, and wherein combustion of the gas generant composition results in a gaseous effluent that is substantially free of hydrogen chloride, carbon monoxide, ammonia, nitrogen dioxide and nitric oxide.

In addition, corresponding or associated methods for generating an inflation gas for inflating an airbag cushion of an inflatable restraint system of a motor vehicle are provided. Such methods typically involve igniting the particular gas generant composition to produce a quantity of inflation gas, and then inflating the airbag cushion with the inflation gas.

The prior art generally fails to provide pyrotechnic gas generant compositions that can simultaneously take advantage of the increased heat and oxygen provided by utilizing ammonium perchlorate as an oxidizer without undesirably increasing undesired gaseous and particulate combustion byproducts in the inflation gas stream.

As used herein, references to "a chlorine scavenger" are to be understood to refer to a material, compound or composition that is capable of reacting with hydrogen chloride gas produced by the combustion of a chlorine-containing material, compound or composition to produce a filterable chlorine-containing material, compound or composition.

Further, references herein to "filterable" materials are to be understood to refer to a material, particle, or compound produced by combustion of a gas generant composition and that may be removed from a gaseous effluent or inflation gas stream such as by passing the gaseous effluent or inflation gas stream through a filter material or media such as a screen or mesh resulting in a decreased level of particulate matter exiting the inflator device.

As used herein, the term "equivalence ratio" is understood to refer to the ratio of the number of moles of oxygen in a gas generant composition or formulation to the number of moles needed to convert hydrogen to water, carbon to carbon dioxide, and any metal to the thermodynamically predicted metal oxide. Thus, a gas generant composition having an equivalence ratio greater than 1.0 is over-oxidized, a gas generant composition having an equivalence ratio less than 1.0 is under-oxidized, and a gas generant composition having an equivalence ratio equal to 1.0 is perfectly oxidized.

As used herein, the term "substantially free of hydrogen chloride" is understood to refer to a gaseous effluent or inflation gas that includes an amount of hydrogen chloride that is equal to or less than an amount of hydrogen chloride permitted by or allowed under current industry standards. For example, if a vehicle includes a single inflatable airbag cushion with a single inflator including a gas generant composition, the gaseous effluent or inflation gas produced by the combustion of the gas generant composition is substantially free of hydrogen chloride if it includes about 5 parts per million hydrogen chloride or less when the inflator is discharged into a 100 $ft^3$ tank.

Correspondingly, the expression "substantially free of", as used herein in reference to possible gaseous effluent constituents such as carbon monoxide, ammonia, nitrogen dioxide and nitric oxide similarly refer to a gaseous effluent or inflation gas that includes such constituent in an amount that is equal to or less than an amount of such constituent permitted by or allowed under current industry standards (USCAR specifications). For example, if a vehicle includes a single inflatable airbag cushion with a single inflator including a gas generant composition, the gaseous effluent or inflation gas produced by the combustion of the gas generant composition is substantially free of carbon monoxide if it includes about 461 parts per million carbon monoxide or less when the inflator is discharged into a 100 $ft^3$ tank; is substantially free of ammonia if it includes about 35 parts per million ammonia or less when the inflator is discharged into a 100 $ft^3$ tank; is substantially free of nitrogen dioxide if it includes about 5 parts per million nitrogen dioxide or less when the inflator is discharged into a 100 $ft^3$ tank; and is substantially free of nitric oxide if it includes about 75 parts per million nitric oxide or less when the inflator is discharged into a 100 $ft^3$ tank.

Other objects and advantages will be apparent to those skilled in the art from the following detailed description taken in conjunction with the appended claims and drawing.

BRIEF DESCRIPTION OF THE DRAWING

The FIGURE is a simplified schematic, partially broken away, view illustrating the deployment of an airbag cushion from an airbag module assembly within a vehicle interior, in accordance with one embodiment of the invention.

DETAILED DESCRIPTION OF THE INVENTION

The present invention provides an improved gas generant composition. In accordance with one aspect of the invention there is provided a chlorine-containing gas generant composition that includes a nitrogen-containing fuel, ammonium perchlorate oxidizer, and a chlorine scavenger in an amount effective to result in a gaseous effluent substantially free of hydrogen chloride. Advantageously, at least about 98 weight percent of the chlorine scavenger is a copper-containing compound.

As discussed above, ammonium perchlorate is a particularly effective oxidizer for gas generant compositions used in the inflation of an automobile inflatable restraint system. However, the use of ammonium perchlorate typically results in the formation undesirable byproducts such as hydrogen chloride or fine particulate matter such as sodium chloride when an alkali or alkaline earth metal scavenger compound is also used. In accordance with the present invention, it has been found that utilizing a chlorine scavenger that predominantly contains a copper-containing compound in a chlorine-containing gas generant composition results in an improved gaseous effluent or inflation gas. In particular, it has generally been found that a filterable copper chloride byproduct is produced that results in a gaseous effluent or inflation gas that is substantially free of hydrogen chloride gas. Additionally, it has advantageously been found that a filterable copper chloride byproduct is produced that results in a reduction in the level of particulate that exits the inflator device.

Moreover, it has unexpectedly been found that including ammonium perchlorate as an oxidant and a scavenger compound predominantly composed of a copper-containing compound in a gas generant composition does not result in an undesirable increase in the level of carbon monoxide in the gaseous effluent or inflation gas produced upon combustion of such a gas generant composition. Such a finding is unexpected in that generally it has been found that including ammonium perchlorate in a gas generant composition typically results in an increased temperature of combustion which in turn results in the production of increased levels of carbon monoxide in the gaseous effluent or inflation gas. Additionally, it has unexpectedly been found that a decrease in carbon monoxide content from expected levels occurs without a countervailing increase in the levels of undesirable oxides of nitrogen such as nitric oxide (NO) or nitrogen dioxide ($NO_2$) which is the usual case.

Further, it has been unexpectedly found that the principal chlorine-containing species found in the gaseous effluent or inflation gas produced by the combustion of a gas generant composition including ammonium perchlorate and a scavenger compound predominantly containing a copper-containing compound is copper (II) chloride ($CuCl_2$) with little or no hydrogen chloride detected. Such a finding is unexpected in that standard thermodynamic prediction computer programs such as the Naval Weapons Center Propellant Evaluation Program (PEP) generally predict the principal chlorine species in the gaseous effluent or inflation gas produced by the combustion of such a chlorine-containing gas generant composition to be cuprous chloride (CuCl) and a trimer of cuprous chloride ($Cu_3Cl_3$) with some hydrogen chloride.

In addition to providing chlorine-containing gas generants that produce improved gaseous effluents upon combustion, it has also been found that the gas yield and burn rates of the chlorine-containing gas generant composition in accordance with the invention can also be improved. Such improved gas yields and burn rates may be obtained as a result of catalyzing the decomposition of the ammonium perchlorate oxidizer without adversely affecting the quality of the gaseous effluent. Advantageously, there are a wide variety of materials that may be used to enhance the burn rate of pyrotechnic or gas generant compositions that contain ammonium perchlorate.

In view of the above, the present invention is directed to a chlorine-containing gas generant composition including a nitrogen-containing fuel, ammonium perchlorate oxidizer; and a chlorine scavenger present in an amount effective to result in a gaseous effluent that is substantially free of hydrogen chloride when the gas generant combusted. Suitably, at least about 98 weight percent of the chlorine scavenger is a copper-containing compound. Desirably, the gas generant composition contains no more than about 1 composition weight percent of a copper-free chlorine scavenger.

In practice, the chlorine-containing gas generant composition may include about 1 to about 20 composition weight percent ammonium perchlorate and about 80 to about 99 percent of a precursor blend containing the nitrogen-containing fuel and the chlorine scavenger.

Useful nitrogen-containing fuels for use in the precursor blend generally include non-azide, organic, nitrogen-containing fuels such as include: amine nitrates, nitramines, heterocyclic nitro compounds, tetrazole compounds, and combinations thereof. While various nitrogen-containing fuels may be used in the chlorine-containing gas generant compositions of the invention, in accordance with certain preferred embodiments, the nitrogen-containing fuel may advantageously be guanidine nitrate. Generally, guanidine nitrate may be desirable due to its good thermal stability, low cost and high gas yield when combusted.

Desirably, the precursor blend may include about 30 to about 70 composition weight percent of a nitrogen-containing fuel. In accordance with certain preferred embodiments, the precursor blend may include about 30 to about 70 composition weight percent guanidine nitrate.

In accordance with the invention, the precursor blend also includes a chlorine scavenger containing at least about 98 weight percent of a copper-containing compound. While various copper-containing compounds may be used in the chlorine-containing gas generants of the invention, suitably the copper-containing compound is selected from copper nitrate complexes (such as a copper-nitrate complex resulting from reaction of 5-aminotetrazole with basic copper nitrate), basic copper nitrate, cupric oxide, copper dinitrate-ammonium nitrate mixture wherein ammonium nitrate is present in the mixture in a range of about 3 to about 90 weight percent, copper diammine bitetrazole, and combinations thereof. Particularly suitable copper-containing compounds for use in the practice of this invention include copper diammine dinitrate-ammonium nitrate mixture wherein ammonium nitrate is present in the mixture in a range of about 3 to about 90 weight percent and basic copper nitrate.

Advantageously, the precursor blend includes about 30 to about 70 composition weight percent of a chlorine scavenger containing at least about 98 weight percent of a copper-containing compound. In accordance with certain preferred embodiments, the precursor blend may include about 30 to about 68 composition weight percent copper diammine dinitrate-ammonium nitrate mixture wherein ammonium nitrate is present in the mixture in a range of about 3 to about 90 weight percent. In the practice of other preferred embodiments, the precursor blend may include about 30 to about 60 composition weight percent basic copper nitrate.

If desired, a chlorine-containing gas generant composition in accordance with the invention may advantageously contain at least one metal oxide burn rate enhancing and slag formation additive. Such metal oxide additives may be added to enhance the burn rate of the chlorine-containing gas generant composition or may be added to assist in the removal of undesirable combustion byproducts by forming filterable particulate material or slag. In practice, the chlorine-containing gas generant compositions of the present invention may include up to about 10 composition weight percent of at least one such metal oxide additive. Suitable metal oxide additives include, but are not limited to, silicon dioxide, aluminum oxide, zinc oxide, and combinations thereof. In accordance with certain preferred embodiments of the invention, the chlorine-containing gas generant compositions of the present invention desirably include about 1 to about 5 composition weight percent of at least one such metal oxide additive. Gas generant compositions in accordance with certain preferred embodiments of the invention desirably contain about 1.5 to about 5 composition weight percent of aluminum oxide metal oxide burn rate enhancing and slag formation additive and up to about 1 composition weight percent of silicon dioxide metal oxide burn rate enhancing and slag formation additive.

In certain preferred embodiment in accordance with the invention, the chlorine-containing gas generant composition may desirably include at least one compound effective to enhance the combustion of the ammonium perchlorate oxidizer. In practice, the chlorine-containing gas generant compositions of the present invention may include up to about 10 composition weight percent of at least one such ammonium perchlorate combustion enhancer. Suitable ammonium perchlorate combustion enhancers include, but are not limited to, iron oxide, copper chromite, ferricyanide/ferrocyanide pigments, and combinations thereof.

In certain preferred embodiments of the invention, the chlorine-containing gas generant advantageously includes at least one ferricyanide/ferrocyanide pigment. Such ferricyanide/ferrocyanide pigments, also referred to as "Iron Blue Pigments" are to be understood to generally refer to that class, family or variety of pigment materials based on microcrystalline Fe(II)Fe(III) cyano complexes. According to results obtained by X-ray and infrared spectroscopy, the basic general chemical formula for the Iron Blue Pigments is believed to be:

$$Me(I)Fe(II)Fe(III)(CN)_6.H_2O \quad (1)$$

In this formula, Me(I) stands for potassium, sodium or ammonium, with the alkali ion being believed to play a decisive role in the color properties of Iron Blue. Iron Blue Pigments, also sometimes referred to as "iron ferricyanides," have been produced or sold under a variety of different names related to either the place where the compound was made or to represent particular optical properties. Examples of such different names include: "Berlin Blue", "Bronze Blue", "Chinese Blue", "Milori Blue", "Non-bronze Blue", "Paris Blue", "Prussian Blue", "Toning Blue" and "Tumbull's Blue", for example.

Those skilled in the art and guided by the teachings herein provided will appreciate that, as identified above, a wide variety of specific or particular Iron Blue Pigment iron ferricyanide materials are available. MANOX-Blue 4050 Iron Blue Pigment iron ferricyanide produced or sold by Degussa Corp. is a currently preferred Iron Blue Pigment material for use in the practice of the invention.

In view of the above, a chlorine-containing gas generant composition in accordance with certain preferred embodiments of the invention may include about 1 to about 20 composition weight percent ammonium perchlorate and about 80 to about 99 composition weight percent of a precursor blend containing about 30 to about 60 composition weight percent guanidine nitrate, about 30 to about 68 composition weight percent copper diammine dinitrate-ammonium nitrate mixture wherein ammonium nitrate is present in the mixture in a range of about 3 to about 90 weight percent, and silicon dioxide in an amount of up to about 10 composition weight percent.

In another aspect, a chlorine-containing gas generant composition in accordance with certain preferred embodiments of the invention may include about 1 to about 20 composition weight percent ammonium perchlorate and about 80 to about 99 composition weight percent of a precursor blend containing about 35 to about 60 composition weight percent guanidine nitrate, about 30 to about 60 composition weight percent basic copper nitrate, and at least one metal oxide additive in an amount up to about 5 composition weight percent. In practice, the precursor blend may further contain at least one ammonium perchlorate combustion enhancer in an amount up to about 5 composition weight percent.

Additional additives such as processing aids may also be included in the chlorine-containing gas generant composition to improve processability of the composition. Generally, such additives may be included in the chlorine-containing gas generant composition in relatively minor concentrations such as no more than about 5 composition weight percent.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1

A chlorine-containing gas generant composition, Example 1, in accordance with the invention and a chlorine-free gas generant composition, Comparative Example 1, having the same equivalence ratio were prepared as shown in TABLE 1.

TABLE 1

| Compound (wt %) | Example 1 | Comparative Example 1 |
|---|---|---|
| Ammonium perchlorate | 20.00 | — |
| Guanidine nitrate | 46.57 | 42.95 |
| Copper diammine dinitrate-ammonium nitrate mixture wherein ammonium nitrate is present as 3 weight percent of the mixture | 29.35 | 51.95 |
| Silicon dioxide | 4.08 | 5.10 |
| Total: | 100.00 | 100.00 |
| Equivalence ratio | 1.0 | 1.0 |

Each gas generant composition was pressed into 0.25 inch diameter by 0.070 inch thick tablets. Thereafter, each gas generant composition was tested by combusting 30 grams of tablets in a test apparatus into a 60-liter tank. The resulting gaseous effluent was analyzed by Fourier transform infrared spectroscopy (FTIR) to identify and quantify the trace species present in the effluent. The residual particles were analyzed using x-ray diffraction spectroscopy (XRF) to identify and quantify the metal species present in the residual particles.

The gas generant composition of Example 1 included 0.13 moles of copper and 0.17 moles of chlorine and had an equivalence ratio of 1.0. For the gas generant composition of Example 1, the Naval Weapons Center Propellant Evaluation Program (PEP) predicted that the gaseous effluent would include hydrogen chloride (HCl), cuprous chloride (CuCl) and a trimer of cuprous chloride($Cu_3Cl_3$). However, FTIR and XRF analysis of the combustion products of the gas generant composition of Example 1, indicated that no hydrogen chloride could be detected and that the principle copper species in the residual particles was copper (II) chloride ($CuCl_2$).

Moreover, comparison of the gaseous byproducts of the combustion the gas generant compositions of Example 1 and Comparative Example 1, as shown in TABLE 2, show that the gas generant composition of Example 1, in accordance with the invention, exhibited a significant decrease in the levels of undesirable trace gas species such as carbon monoxide, nitric oxide, and nitrogen dioxide, as compared to the gas generant composition of Comparative Example 1.

TABLE 2

| Gas Species (ppm) | Example 1 | Comparative Example 1 |
|---|---|---|
| Carbon monoxide | 1385 | 5231 |
| Nitric oxide | 3744 | 5427 |
| Nitrogen dioxide | 36 | 377 |

Example 2

A chlorine-containing gas generant composition, Example 2, in accordance with the invention and a chlorine-free gas generant composition, Comparative Example 2, having about the same equivalence ratio were prepared as shown in TABLE 3.

TABLE 3

| Compound (wt %) | Example 2 | Comparative Example 2 |
|---|---|---|
| Ammonium perchlorate | 3.00 | — |
| Guanidine nitrate | 48.87 | 50.38 |
| Basic copper nitrate | 45.22 | 46.62 |
| Silicon dioxide | 0.29 | 0.30 |
| Aluminum oxide | 2.62 | 2.70 |
| Total | 100.00 | 100.00 |
| Equivalence ratio | 1.04 | 1.02 |

Each gas generant composition was formed into tablets having a diameter of 0.25 inches and a thickness of 0.070 inches. The gas generant compositions were tested by combusting 42 grams of tablets in a standard passenger inflator into a 100 cubic foot tank. The resulting gaseous effluent was tested by FTIR to identify and quantify the trace species present in the effluent.

Based upon past experience, it was expected that the gas generant composition of Example 2 would produce a gaseous effluent with an increase in nitrogen oxides compared to gas generant composition of Comparative Example 2. However, analysis of the gaseous effluents of each gas generant composition, as shown in TABLE 4, indicated that the gas generant composition of Example 2 produced a gaseous effluent having no detectable hydrogen chloride, reduced carbon monoxide levels, and no significant increase in nitric oxide compared to the gas generant composition of Comparative Example 2.

TABLE 4

| Gas species (ppm) | Example 2 | Comparative Example 2 |
|---|---|---|
| Carbon monoxide | 144 | 161 |
| Nitric oxide | 24 | 22 |

Example 3

A chlorine-containing gas generant composition, Example 3 in accordance with the invention and a standard chlorine-free gas generant composition, Comparative Example 3, that is similar were prepared as shown in Table 5.

The burn rate date, as shown in Table 5 below, was obtained by first pressing samples of the respective gas generant compositions into the shape or form of a 0.5 inch diameter cylinder using a hydraulic press (12,000 lbs. force). Typically, enough powdered composition was used to result in a cylinder length of 0.5 inch. The cylinders were then each coated on all surfaces except the top surface with a krylon ignition inhibitor to help ensure a linear burn in the test apparatus. In each case, the so-coated cylinders were placed in a 1-liter closed vessel or test chamber capable of being pressurized to several thousand psi with nitrogen and equipped with a pressure transducer for accurate measurement of test chamber pressure. A small sample of igniter powder was placed on top of the cylinder and a nichrome wire was passed through the igniter powder and connected to electrodes mounted in the lid of the test chamber. The test chamber was then pressurized to the desired pressure and the sample ignited by passing a current through the nichrome wire. Pressure versus time data was collected as each of the respective samples were burned. Since combustion of each of the samples generated gas, an increase in test chamber pressure signaled the start of combustion and a "leveling off" of pressure signaled the end of combustion. The time required for combustion was equal to $t_2-t_1$, where $t_2$ is the time at the end of combustion and $t_1$ is the time at the start of combustion. The sample weight was divided by combustion time to determine the burning rate in grams per second. Burning rates were typically measured at four pressures (900, 1350, 2000 and 3000 psi). The log of the burn rate versus the log of average pressure was then plotted. From this line the burn rate at any pressure can be calculated using the following burn rate equation:

$$r_b=K(P)^n$$

where:

$r_b$=burn rate (linear)

K=constant

P=pressure n=pressure constant.

As can be seen in TABLE 5, both the burn rate and the gas yield produced by the combustion of the gas generant composition of Example 3 are improved over the gas generant composition of Comparative Example 3.

TABLE 5

| Compound (wt %) | Example 3 | Comparative Example 3 |
|---|---|---|
| Ammonium perchlorate | 10.00 | — |
| Guanidine nitrate | 49.63 | 50.38 |
| Basic copper nitrate | 38.37 | 46.62 |
| Silicon dioxide | — | 0.30 |
| Aluminum oxide | 1.50 | 2.70 |
| MANOX iron blue | 0.50 | — |
| Total | 100.00 | 100.00 |
| Results | | |
| Burn rates (inch/second @ 3000 psi) | 1.12 | 0.82 |
| Gas yields (moles/100 grams) | 3.00 | 2.87 |

Thus, the invention provides chlorine-containing gas generant compositions having an improved effluent. In particular, the present invention provides a chlorine-containing gas generant including ammonium perchlorate oxidizer and a precursor blend containing a nitrogen-containing fuel and a chlorine scavenger in an amount effective to result in a gaseous effluent that is substantially free of hydrogen chloride when the gas generant composition is combusted, wherein at least about 98 weight percent of the chlorine scavenger is a copper-containing compound. Moreover, the present invention provides a chlorine-containing gas generant composition that produces lower levels of undesirable trace gas species such as carbon monoxide and nitric oxide upon combustion. Additionally, the present invention provides a chlorine-containing gas generant composition having an improved burn rate and gas yield when compared to an ammonium perchlorate-free gas generant composition.

In accordance with another aspect of the invention it has been discovered that a gas generant effluent product can be dramatically improved (e.g., the resulting effluent has a significantly reduced content of undesirable materials such as one or more of hydrogen chloride, carbon monoxide, ammonia, nitrogen dioxide and nitric oxide) via the inclusion, in the gas generant composition, of ammonium perchlorate particles of sufficient particle size. More specifically, it has been found that the inclusion, in a gas generant composition, of ammonium perchlorate particles having a mean particle size in excess of 100 microns and, preferably, a mean particle size of at least about 200 microns can dramatically improve the effluent resulting from the combustion of a gas generant composition which includes such sized ammonium perchlorate particles, as compared to the effluent resulting from the combustion of the same gas generant composition but without the so sized ammonium perchlorate particles. In accordance with at least certain preferred embodiments of the invention, it has been found advantageous that ammonium perchlorate particles included in gas generant compositions in accordance with the invention have a mean particle size in the range of about 350 to about 450 microns.

In practice, it has been found desirable that gas generant compositions in accordance with this aspect of the invention desirably include the desirably-sized ammonium perchlorate particles in a relative amount of about 1 to about 10 composition weight percent.

Gas generant compositions having equivalence ratios in the range of about 0.96 to about 1.06, preferably in the range of about 0.99 to about 1.04 have been found desirable in improving product effluent such as in reducing or minimizing the amount of undesirable gas species such as carbon monoxide, ammonia, nitrogen dioxide and nitric oxide, for example.

Suitable gas generant compositions in accordance with the invention include:

1. a composition, alternatively, comprising, consisting and consisting essentially of:
   - about 40 to about 60 composition weight percent guanidine nitrate;
   - about 35 to about 50 composition weight percent basic copper nitrate;
   - about 1 to about 10 composition weight percent ammonium perchlorate in a mean particle size in excess of 100 microns; and
   - about 1 to about 5 composition weight percent of metal oxide burn rate enhancing and slag formation additive;
2. a composition, alternatively, comprising, consisting and consisting essentially of:
   - about 40 to about 50 composition weight percent guanidine nitrate;
   - about 40 to about 55 composition weight percent copper diammine dinitrate-ammonium nitrate mixture wherein ammonium nitrate is present in the mixture in a range of about 3 to about 90 weight percent;
   - about 1 to about 10 composition weight percent ammonium perchlorate in a mean particle size in excess of 100 microns; and
   - about 1 to about 5 composition weight percent of at least one metal oxide burn rate enhancing and slag formation additive;

3. a composition, alternatively, comprising, consisting and consisting essentially of:
   about 10 to about 40 composition weight percent guanidine nitrate;
   about 45 to about 60 composition weight percent basic copper nitrate;
   about 5 to about 30 composition weight percent copper diammine bitetrazole;
   about 1 to about 10 composition weight percent ammonium perchlorate in a mean particle size in excess of 100 microns;
   about 1 to about 5 composition weight percent of at least one metal oxide burn rate enhancing and slag formation additive; and
4. a composition, alternatively, comprising, consisting and consisting essentially of:
   about 10 to about 60 composition weight percent guanidine nitrate;
   about 1 to about 35 composition weight percent basic copper nitrate;
   about 10 to about 60 composition weight percent of a copper-nitrate complex resulting from reaction of 5-aminotetrazole with basic copper nitrate;
   about 1 to about 10 composition weight percent ammonium perchlorate in a mean particle size in excess of 100 microns; and
   about 1 to about 5 composition weight percent of at least one metal oxide burn rate enhancing and slag formation additive.

In particular, the copper-nitrate complex resulting from reaction of 5-aminotetrazole with basic copper nitrate is believed to be a copper, hydroxy nitrate 1H-tetrazol-5-amine complex.

Various preparation techniques, such as known in the art, can be used to prepare the gas generant compositions in accordance with invention. For example, the various gas generant composition compounds (other than the ammonium perchlorate) can be prepared such as by slurry mixing, followed by spray drying to form a homogeneous powder. Such a homogeneous powder can then be blended with the desired size ammonium perchlorate particles using a low energy input mixer such as to retain the ammonium perchlorate in the desired particle size. The resulting blend can then be appropriately processed, such as by tableting, for example, to form the composition into specifically desired shapes or forms.

While those skilled in the art and guided by the teachings herein provided will appreciate that various preparation techniques, such as known in the art, can be used to prepare the gas generant compositions in accordance with invention, practice of the invention generally requires that the final gas generant composition include the ammonium perchlorate particles in the specified size range.

The invention further comprehends methods for inflating an airbag cushion of an inflatable restraint system of a motor vehicle including the steps of igniting a gas generant composition in accordance with the invention to produce a quantity of inflation gas and then inflating the airbag cushion with the inflation gas. As will be appreciated, the inflation gas is substantially free of hydrogen chloride and also substantially free of carbon monoxide, ammonia, nitrogen dioxide and nitric oxide.

As will be appreciated, gas generating compositions in accordance with the invention can be incorporated, utilized or practiced in conjunction with a variety of different structures, assemblies and systems. As representative, the FIGURE illustrates a vehicle 10 having an interior 12 wherein an inflatable vehicle occupant safety restraint system, generally designated by the reference numeral 14, is positioned. As will be appreciated, certain standard elements not necessary for an understanding of the invention may have been omitted or removed from the FIGURE for purposes of facilitating illustration and comprehension.

The vehicle occupant safety restraint system 14 includes an open-mouthed reaction canister 16 which forms a housing for an inflatable vehicle occupant restraint 20, e.g., an inflatable airbag cushion, and an apparatus, generally designated by the reference numeral 22, for generating or supplying inflation gas for the inflation of an associated occupant restraint. As identified above, such a gas generating device is commonly referred to as an "inflator."

The inflator 22 contains a quantity of a gas generant composition in accordance with the invention and such as described above. The inflator 22 also includes an ignitor, such as known in the art, for initiating combustion of the gas generating composition in ignition communication with the gas generant composition. As will be appreciated, the specific construction of the inflator device does not form a limitation on the broader practice of the invention and such inflator devices can be variously constructed such as is also known in the art.

In practice, the airbag cushion 20 upon deployment desirably provides for the protection of a vehicle occupant 24 by restraining movement of the occupant in a direction toward the front of the vehicle, i.e., in the direction toward the right as viewed in the FIGURE.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Comparative Examples 4 and 5 and Examples 4–6

For each of these tests, the compositions shown in TABLE 6 (compound values in terms of "composition wt %"), were prepared. More specifically, the basic copper nitrate, guanidine nitrate, aluminum oxide and silicon dioxide were slurry mixed and then spray dried to form a powder precursor. In those tests that included ammonium perchlorate, the desired size ammonium perchlorate particles were blended with the powder precursor using a low energy input mixer such as to retain the ammonium perchlorate in the desired particle size. The resulting blend was then appropriately tableted using common tableting processing.

TABLE 6

| Compound (wt %) | CE 4 | CE 5 | Example 4 | Example 5 | Example 6 |
|---|---|---|---|---|---|
| bCN | 46.62 | 45.27 | 45.2 | 45.2 | 42.47 |
| $GuNO_3$ | 50.38 | 51.72 | 48.91 | 48.91 | 51.53 |
| $Al_2O_3$ | 2.7 | 2.7 | 2.6 | 2.6 | 2.7 |
| $SiO_2$ | 0.3 | 0.3 | 0.29 | 0.29 | 0.3 |
| AP (20 μ) | na | na | 3 | na | na |
| AP (200 μ) | na | na | na | 3 | na |
| AP (400 μ) | na | na | na | na | 3 |
| Properties | | | | | |
| ER | 1.02 | 1.00 | 1.04 | 1.04 | 1.00 |

TABLE 6-continued

| Compound (wt %) | CE 4 | CE 5 | Example 4 | Example 5 | Example 6 |
|---|---|---|---|---|---|

where,
bCN = basic copper nitrate;
$GuNO_3$ = guanidine nitrate;
AP = ammonium perchlorate; and
na = not applicable.

The tableted compositions were evaluated using a standard test apparatus hardware wherein each of the compositions was combusted and discharged into a 100 cubic foot tank. Three runs were made using each of the compositions of Comparative Examples 4 and 5 (CE 4 and CE 5) and Examples 4 and 5 (Ex 4 and Ex 5) and 10 runs were made using the composition of Example 6 (Ex 6). The resulting gaseous effluent for each run was tested by FTIR to identify and quantify the trace species present in the effluent, the average obtain for the runs using each of the compositions are shown in TABLE 7. Also shown in TABLE 7 are the USCAR specifications for each of the listed constituents.

TABLE 7

| | CE 4 | CE 5 | Ex 4 | Ex 5 | Ex 6 | USCAR |
|---|---|---|---|---|---|---|
| CO | 330 | 410 | 240 | 180 | 338 | 461 |
| $NH_3$ | 100 | 210 | 15 | 30 | 21 | 35 |
| NO | 85 | 55 | 130 | 105 | 32 | 75 |
| $NO_2$ | 20 | 4 | 50 | 9 | <1 | 5 |
| HCl | 0 | 0 | <2 | <2 | <2 | 5 |

Discussion of Results

As shown by TABLE 6, the composition of Comparative Example 4 (CE 4) failed to satisfy the specification for $NH_3$, NO and $NO_2$. However, in Comparative Example 5 (CE 5), where the equivalence ratio (ER) was lowered to 1.00, the NO and $NO_2$ were improved to the point that the composition satisfied the specifications relating thereto, however, CO and $NH_3$ increased beyond the specification limits. Thus, the compositions of Comparative Examples 4 and 5 evidenced a performance sometimes referred to as the equivalence ratio "teeter-totter". That is, as the equivalence ratio is lowered, under-oxidized species, such as CO and $NH_3$, increase and over-oxidized species, such as NO and $NO_2$, decrease. The reverse is true when the equivalence ratio is increased.

The inclusion of 20 micron ammonium perchlorate at an equivalence ratio of 1.04 (Example 4) lowered CO and $NH_3$ levels but raised NO and $NO_2$ levels as compared to Comparative Example 4. This is as expected as a result of the aforementioned equivalence ratio teeter-totter. However, the inclusion of ammonium perchlorate in a particle size of 200 microns at the same equivalence ratio, as in Example 5, improved the effluent with respect to CO, NO and $NO_2$. Moreover, in Example 6, the inclusion of ammonium perchlorate in a particle size of 400 microns and with the composition at an equivalence ratio of 1.00 dramatically improved effluents in all categories (CO, $NH_3$, NO, and $NO_3$), with each specification being appropriately satisfied.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. In an ammonium perchlorate-containing gas generant composition that includes a non-azide, organic, nitrogen-containing fuel, the improvement comprising:

the ammonium perchlorate being present with a mean particle size in excess of 200 microns, and the ammonium perchlorate-containing gas generant composition also containing a chlorine scavenger present in an amount effective to result in a gaseous effluent that is substantially free of hydrogen chloride when the gas generant is combusted, wherein at least about 98 weight percent of the chlorine scavenger is a copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof.

2. The ammonium perchlorate-containing gas generant composition of claim 1 wherein the ammonium perchlorate is present in a mean particle size in the range of about 350 to about 450 microns.

3. The ammonium perchlorate-containing gas generant composition of claim 1 having an equivalence ratio in the range of about 0.96 to about 1.06.

4. The ammonium perchlorate-containing gas generant composition of claim 1 wherein upon combustion thereof the gaseous effluent is also substantially free of carbon monoxide, ammonia, nitrogen dioxide and nitric oxide.

5. The ammoniumperchlorate-containing gas generant composition of claim 1 wherein the non-azide, organic, nitrogen-containing fuel is selected from the group consisting of amine nitrates, nitramines, heterocyclic nitro compounds, tetrazole compounds and combinations thereof.

6. The ammonium perchlorate-containing gas generant composition of claim 1 wherein the non-azide nitrogen-containing fuel is guanidine nitrate.

7. The ammonium perchlorate-containing gas generant composition of claim 1 wherein the copper-containing compound is basic copper nitrate.

8. The ammonium perchlorate-containing gas generant composition of claim 1 wherein the copper-containing compound is cupric oxide.

9. The ammonium perchlorate-containing gas generant composition of claim 1 wherein the copper-containing compound is copper diammine dinitrate-ammonium nitrate mixture wherein ammonium nitrate is present in the mixture in a range of about 3 to about 90 weight percent.

10. The ammonium perchlorate-containing gas generant composition of claim 1 wherein the copper-containing compound is copper diammine bitetrazole.

11. The ammonium perchlorate-containing gas generant composition of claim 1 wherein the copper-containing compound is a copper-nitrate complex resulting from reaction of 5-aminotetrazole with basic copper nitrate.

12. The ammonium perchlorate-containing gas generant composition of claim 1 containing no more than about 1 composition weight percent of a copper-free chlorine scavenger.

13. The ammonium perchlorate-containing gas generant composition of claim 12 wherein the non-azide, organic, nitrogen-containing fuel, the ammonium perchlorate, the copper-containing compound and any metal oxide additives present in the ammonium perchlorate-containing gas generant composition, are present in sufficient relative amounts that the ammonium perchlorate-containing gas generant composition has an equivalence ratio in the range of about 0.96 to about 1.06 and wherein combustion of the gas generant composition results in a gaseous effluent that is also substantially free of carbon monoxide, ammonia, nitrogen dioxide and nitric oxide.

14. The ammonium perchlorate-containing gas generant composition of claim 1 consisting essentially of:

about 40 to about 60 composition weight percent guanidine nitrate;

about 35 to about 50 composition weight percent basic copper nitrate;

about 1 to about 10 composition weight percent ammonium perchlorate in a mean particle size in excess of 200 microns; and about 1 to about 5 composition weight percent of metal oxide burn rate enhancing and slag formation additive.

15. The ammonium perchlorate-containing gas generant composition of claim 1 consisting essentially of:

about 40 to about 50 composition weight percent guanidine nitrate;

about 40 to about 55 composition weight percent copper diammine dinitrate-ammonium nitrate mixture wherein ammonium nitrate is present in the mixture in a range of about 3 to about 90 weight percent;

about 1 to about 10 composition weight percent ammonium perchlorate in a mean particle size in excess of 200 microns; and about 1 to about 5 composition weight percent of at least one metal oxide burn rate enhancing and slag formation additive.

16. The ammonium perchlorate-containing gas generant composition of claim 1 wherein the composition comprises:

about 10 to about 40 composition weight percent guanidine nitrate;

about 45 to about 60 composition weight percent basic copper nitrate;

about 5 to about 30 composition weight percent copper diammine bitetrazole;

about 1 to about 10 composition weight percent ammonium perchlorate in a mean particle size in excess of 200 microns;

about 1 to about 5 composition weight percent of at least one metal oxide burn rate enhancing and slag formation additive.

17. The ammonium perchlorate-containing gas generant composition of claim 1 wherein the composition comprises:

about 10 to about 60 composition weight percent guanidine nitrate;

about 1 to about 35 composition weight percent basic copper nitrate;

about 10 to about 60 composition weight percent a copper-nitrate complex resulting from reaction of 5-aminotetrazole with basic copper nitrate;

about 1 to about 10 composition weight percent ammonium perchlorate in a mean particle size in excess of 200 microns;

about 1 to about 5 composition weight percent of at least one metal oxide burn rate enhancing and slag formation additive.

18. A method for generating an inflation gas for inflating an airbag cushion of an inflatable restraint system of a motor vehicle comprising the steps of:

igniting the ammonium perchlorate-containing gas generant composition of claim 1 to produce a quantity of inflation gas; and inflating the airbag cushion with the inflation gas.

19. The method of claim 18 wherein the inflation gas is substantially free of hydrogen chloride.

20. An ammonium perchlorate-containing gas generant composition consisting essentially of:

a non-azide, organic, nitrogen-containing fuel, a copper-containing chlorine scavenger selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof;

about 1 to about 10 composition weight percent ammonium perchlorate in a mean particle size in excess of 200 microns and about 1 to about 5 composition weight percent of at least one metal oxide burn rate enhancing and slag formation additive selected from the group consisting of silicon dioxide, aluminum oxide, zinc oxide, and combinations thereof, wherein the gas generant composition contains no more than about 1 composition weight percent of a copper-free chlorine scavenger, wherein the non-azide, organic, nitrogen-containing fuel, the copper-containing chlorine scavenger, the ammonium perchlorate and metal oxide burn rate enhancing and slag formation additive are present in sufficient relative amounts that the gas generant composition has an equivalence ratio in the range of about 0.96 to about 1.06, and wherein combustion of the gas generant composition results in a gaseous effluent that is substantially free of hydrogen chloride, carbon monoxide, ammonia, nitrogen dioxide and nitric oxide.

21. The ammonium perchlorate-containing gas generant composition of claim 20 wherein the ammonium perchlorate is present in a mean particle size in the range of about 350 to about 450 microns.

22. The ammonium perchlorate-containing gas generant composition of claim 20 consisting essentially of:

about 40 to about 60 composition weight percent guanidine nitrate;

about 35 to about 50 composition weight percent basic copper nitrate;

about 1 to about 10 composition weight percent ammonium perchlorate in a mean particle size in excess of 200 microns; and about 1 to about 5 composition weight percent of metal oxide burn rate enhancing and slag formation additive.

23. The ammonium perchlorate-containing gas generant composition of claim 20 consisting essentially of:

about 40 to about 50 composition weight percent guanidine nitrate;

about 40 to about 55 composition weight percent copper diammine dinitrate-ammonium nitrate mixture wherein ammonium nitrate is present in the mixture in a range of about 3 to about 90 weight percent;

about 1 to about 10 composition weight percent ammonium perchlorate in a mean particle size in excess of 200 microns;

about 1 composition weight percent of at least one metal oxide burn rate enhancing and slag formation additive.

24. The ammonium perchlorate-containing gas generant composition of claim 20 consisting essentially of:

about 10 to about 40 composition weight percent guanidine nitrate;

about 45 to about 60 composition weight percent basic copper nitrate;

about 5 to about 30 composition weight percent copper diammine bitetrazole;

about 1 to about 10 composition weight percent ammonium perchlorate in a mean particle size in excess of 200 microns;

about 1 to about 5 composition weight percent of at least one metal oxide burn rate enhancing and slag formation additive.

25. The ammonium perchlorate-containing gas generant composition of claim 20 consisting essentially of:

about 10 to about 60 composition weight percent guanidine nitrate;

about 1 to about 35 composition weight percent basic copper nitrate;

about 10 to about 60 composition weight percent a copper-nitrate complex resulting from reaction of 5-aminotetrazole with basic copper nitrate;

about 1 to about 10 composition weight percent ammonium perchlorate in a mean particle size in excess of 200 microns;

about 1 to about 5 composition weight percent of at least one metal oxide burn rate enhancing and slag formation additive.

26. A method for generating an inflation gas for inflating an airbag cushion of an inflatable restraint system of a motor vehicle comprising the steps of:

igniting the ammonium perchlorate-containing gas generant composition of claim 20 to produce a quantity of inflation gas; and inflating the airbag cushion with the inflation gas.

* * * * *